US006786448B2

(12) United States Patent
Arcilesi

(10) Patent No.: US 6,786,448 B2
(45) Date of Patent: Sep. 7, 2004

(54) FIXED-SPOOL TOILET PAPER DISPENSER WITH REMOVABLE OUTER BRACKET AND METHOD

(76) Inventor: Damian Arcilesi, 9550 W. Sahara Ave., #2066, Las Vegas, NV (US) 89117

( * ) Notice: Subject to any disclaimer, the term of this patent is extended or adjusted under 35 U.S.C. 154(b) by 0 days.

(21) Appl. No.: 10/164,343

(22) Filed: Jun. 7, 2002

(65) Prior Publication Data

US 2003/0226930 A1 Dec. 11, 2003

(51) Int. Cl.[7] ..... B65H 18/04
(52) U.S. Cl. ..... 242/597.4; 242/597.5
(58) Field of Search ..... 242/597.4, 597.5, 242/597.6, 597.8

(56) References Cited

U.S. PATENT DOCUMENTS

| | | | | | |
|---|---|---|---|---|---|
| 777,981 | A | * | 12/1904 | Sterling | 242/571.5 |
| 1,204,810 | A | * | 11/1916 | Mercer | 242/597.8 |
| 1,269,411 | A | * | 6/1918 | Edwards | 242/597.4 |
| 2,529,420 | A | * | 11/1950 | Ramquist | 242/597.4 |
| 3,168,258 | A | * | 2/1965 | Schwartz | 242/560.2 |
| 3,319,855 | A | * | 5/1967 | Tucker et al. | 225/67 |
| 4,553,711 | A | * | 11/1985 | Urion et al. | 242/591 |
| 4,807,823 | A | * | 2/1989 | Wyant | 242/560 |
| 5,385,318 | A | * | 1/1995 | Rizzuto | 242/597.8 |
| 5,524,835 | A | * | 6/1996 | Collins | 242/560 |
| 5,577,686 | A | * | 11/1996 | Moody | 242/597.4 |
| 5,628,474 | A | * | 5/1997 | Krueger et al. | 242/559.4 |
| 5,762,285 | A | * | 6/1998 | Lin | 242/565 |

* cited by examiner

*Primary Examiner*—Donald R. Walsh
*Assistant Examiner*—Joseph C Rodriguez
(74) *Attorney, Agent, or Firm*—Jeffrey Weiss; Harry M. Weiss; Weiss, Moy & Harris, P.C.

(57) ABSTRACT

A toilet paper dispenser is disclosed which contains a spool that extends at a right angle from a mounting plate secured to a surface. The mounting plate may, optionally, be mounted to a wall surface or may be recessed. The spool receives a roll of toilet paper thereon, and has an end cap that is removably coupled to an end of the spool, after placement of the toilet paper roll on the spool to prevent the roll from coming off of the spool. The toilet paper dispenser includes a top cover positioned so as to conceal a top portion of the toilet paper roll when the mounting plate is mounted on a wall surface. When a drywall type surface is used, a butterfly type anchor permits attachment of the mounting plate to the drywall type surface.

4 Claims, 2 Drawing Sheets

FIXED-SPOOL TOILET PAPER DISPENSER WITH REMOVABLE OUTER BRACKET AND METHOD

FIELD OF THE INVENTION

This invention relates generally to toilet paper dispensers and, more particularly, to a fixed-spool toilet paper dispenser, preferably made of plastic and having a removable outer bracket, which outer bracket may be of either the snap-on or screw-on type.

BACKGROUND OF THE INVENTION

Toilet dispensers come in a variety of shapes and styles. Dispensers found in households typically consist of two posts (or the like) that extend outwardly and at a right angle from a bathroom wall. The posts are positioned far enough apart so that a spring-loaded cylinder, having a roll of toilet paper thereon, may be fitted between the posts and removably coupled thereto. For some users, including for example those suffering from arthritis or other conditions affecting the use of the hands, it can be difficult to load a roll of toilet paper onto such a dispenser. Even women with long fingernails can find it difficult or inconvenient to perform such a task.

A need existed for an improved toilet paper dispenser that requires less manual dexterity to load and unload the roll—while still providing for the secure retention of the roll on the dispenser. The improved dispenser should eliminate the need for a spring-loaded cylinder that must be coupled to posts, and instead should allow the roll to be placed onto the open end of a fixed-length cylinder. The improved dispenser should further include an end cap, having a diameter of about three inches, that will hold the roll in place during use, but that may be easily removed when it is necessary to position a new roll on the fixed-length cylinder. The end cap should be of the snap-on or screw-on type. Preferably, the improved dispenser should include a cover over the roll, to partially shield the paper from view and further to assist in the process of tearing a section of paper from the roll. The improved dispenser should, preferably, be formed from plastic.

The present invention satisfies these needs and provides other, related, advantages.

SUMMARY OF THE INVENTION

It is an object of the present invention to provide an improved toilet paper dispenser that requires less manual dexterity to load and unload the roll as compared to prior art dispensers—while still providing for the secure retention of the roll on the dispenser.

It is a further object of the present invention to provide an improved toilet paper dispenser that allows the roll to be placed onto the open end of a fixed-length cylinder, and thus eliminates the need for fitting a spring-loaded cylinder between two posts.

It is yet a further object of the present invention to provide an improved toilet paper dispenser having a fixed-length cylinder onto which a toilet paper roll may be positioned, and having a readily removable end cap on the fixed-length cylinder to hold the roll in place during use.

It is a still further object of the present invention to provide an improved toilet paper dispenser that includes a cover over the roll, to partially shield the paper from view and further to assist in the process of tearing a section of paper from the roll.

It is a further object of the present invention to provide an improved toilet paper dispenser that may be strongly attached to drywall, which strengthened attachment is achieved with butterfly anchors or the like.

BRIEF DESCRIPTION OF THE PREFERRED EMBODIMENTS

In accordance with one embodiment of the present invention, an improved toilet paper dispenser is disclosed. The improved toilet paper dispenser comprises, in combination: a mounting plate; a spool having a first end and a second end and adapted to receive thereon a roll of toilet paper; wherein the spool is coupled at the first end to the mounting plate; wherein the spool projects at a substantially right angle from the mounting plate; and an end cap detachably coupled to the second end of the spool and dimensioned to prevent the toilet paper from being removed from the spool.

In accordance with another embodiment of the present invention, an improved toilet paper dispenser is disclosed. The improved toilet paper dispenser comprises, in combination: a mounting plate; means for attaching the mounting plate to a surface of a wall; wherein the attaching means comprise a plurality of openings in the mounting plate, through which mounting hardware may be inserted; a spool having a first end and a second end and adapted to receive thereon a roll of toilet paper; wherein the spool is coupled at the first end to the mounting plate; wherein the spool projects at a substantially right angle from the mounting plate; wherein the spool comprises a tapered section and a cylindrical section; an end cap detachably coupled to the second end of the spool and dimensioned to prevent the toilet paper from being removed from the spool; and a top cover coupled to the mounting plate and positioned so as to extend over a top portion of the roll of toilet paper when in position on the spool.

In accordance with yet another embodiment of the present invention, a method for dispensing toilet paper is disclosed. The method comprises the steps of providing a mounting plate; providing a spool having a first end and a second end and adapted to receive thereon a roll of toilet paper; wherein the spool is coupled at the first end to the mounting plate; wherein the spool projects at a substantially right angle from the mounting plate; providing an end cap detachably coupled to the second end of the spool and dimensioned to prevent the toilet paper from being removed from the spool; mounting the mounting plate to a surface; detaching the end cap from the second end of the spool; positioning the roll of toilet paper on the spool; and coupling the end cap to the second end of the spool.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
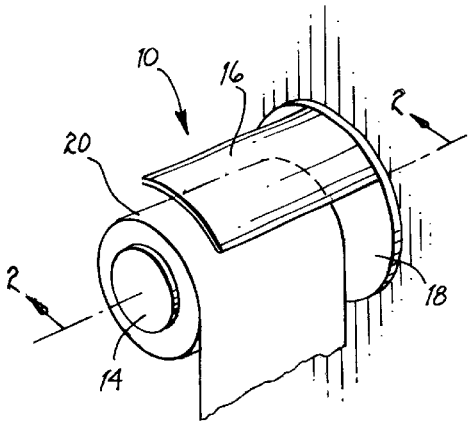
FIG. 1 is a perspective view of an embodiment of a toilet paper dispenser consistent with the present invention.
Figure 2:
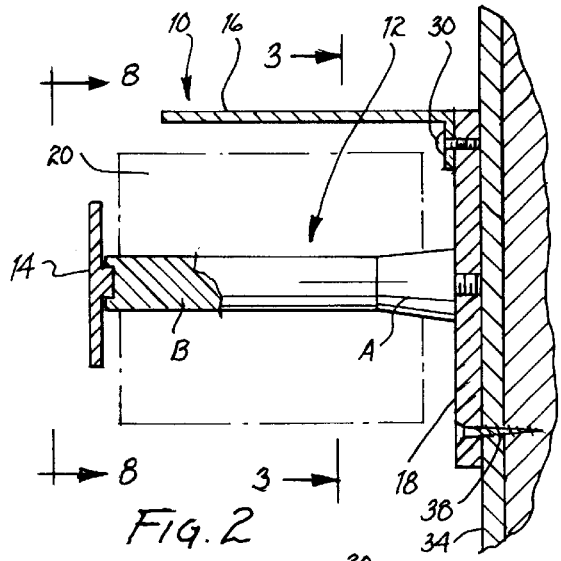
FIG. 2 is a side, cross-sectional view of the toilet paper dispenser of FIG. 1, taken along line 2—2

Referring first to FIGS. 1–4, an embodiment of a toilet paper dispenser 10 (hereinafter "dispenser 10") is shown. The main components of the dispenser 10 are a spool 12, an end cap 14, a top cover 16, and a mounting plate 18. With respect to the assembly of the dispenser 10, as best seen in FIG. 2, the spool 12 is coupled at a first end thereof to the mounting plate 18, the end cap 14 is coupled to the second end of the spool 12 and retains a roll 20 of toilet paper in position on the spool 12, and the top cover 16 is also coupled to the mounting plate 18 and is positioned so as to be above a surface of an unused roll 20 of toilet paper.

Referring specifically to FIG. 2, it is preferred that the spool 12 comprise a tapered section A and a cylindrical section B. Tapered section A, which will be adjacent the mounting plate 18, preferably tapers from about a one inch outer diameter to about a three-quarters of one inch outer diameter and has a length of about one inch. Section B has an outer diameter of about three-quarters of one inch and a length of about four and one-half inches. The purpose of tapered section A is to increase the strength of spool 12. It also serves to prevent an end portion of roll 20 from scraping against the surface of mounting plate 18 by providing an outer diameter that, as the mounting plate 18 is neared, is greater than that of the diameter of the cylindrical opening through the roll 20.

Figure 9:
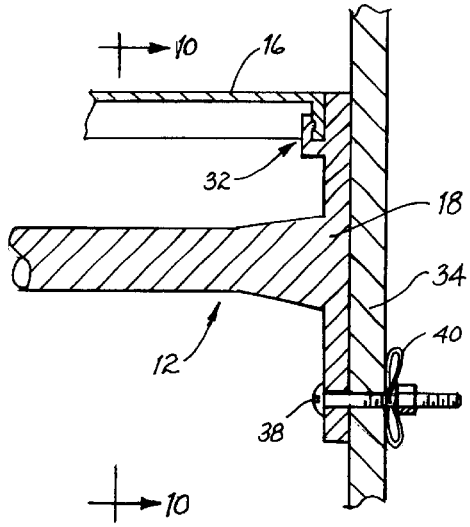
FIG. 9 is a side, cross-sectional view of another embodiment of a toilet paper dispenser consistent with the present invention.

The spool 12 may be coupled to the mounting plate 18 in any desired manner. For example, and as shown in FIG. 9, the spool 12 and mounting plate 18 may be a one-piece assembly. Alternatively, the spool 12 could be coupled to the mounting plate 18. See FIG. 2. This may be accomplished by inserting a threaded bolt (not shown) through mounting plate 18 and into a mating threaded opening (not shown) within spool 12. Other coupling methods may also be utilized.

It is preferred that the component portions of the dispenser 10 as described herein be constructed of molded plastic, so as to make the mass-production of dispensers 10 more convenient. On the other hand, if desired, it would be possible to construct the dispenser 10 from other material, such as metal or wood.

Figure 4:
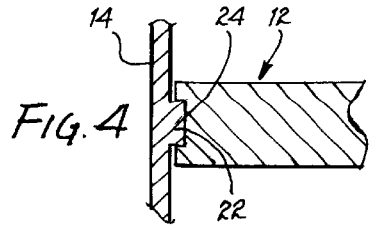
FIG. 4 is a side, cross-sectional view of the end cap portion of the toilet paper dispenser of FIG. 2.
Figure 5:
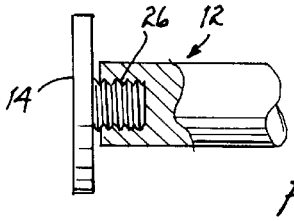
FIG. 5 is a side, cross-sectional view of another embodiment of the end cap portion of a toilet paper dispenser consistent with the present invention.

Referring now to the end cap 14, it is removably coupled to the end of the spool 12 opposite the mounting plate 18. Such removable coupling can be accomplished in a number of different ways. For example, as shown in FIG. 4, the end cap 14 may snap into (and out of) the end of the spool 12, with a projection 22 extending from a base of the end cap 14 being received in a mating opening 24 in the spool 12. Alternatively, as shown by way of example in FIG. 5, the end cap 14 may have a threaded projection 26 extending from a base of the end cap 14, with the threaded projection 26 being threadably received within threaded opening 28 in the spool 12. The end cap preferably has a diameter of about three inches.

Figure 10:
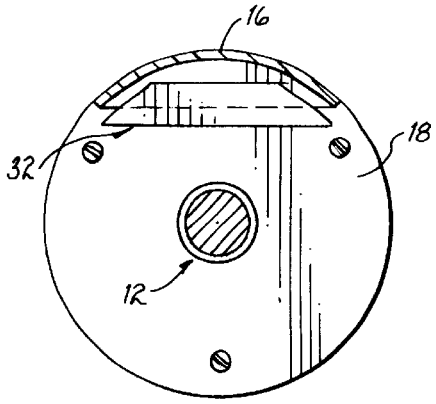
FIG. 10 is an end, cross-sectional view of the toilet paper dispenser of FIG. 9, taken along line 10—10.
Figure 8:
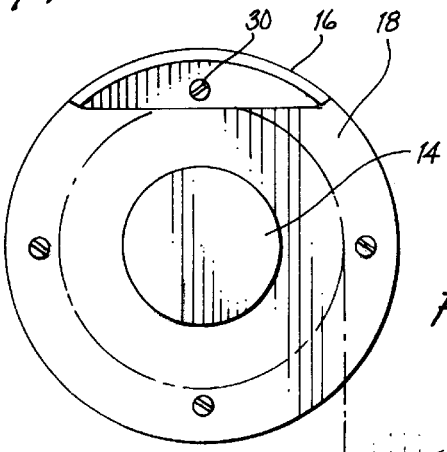
FIG. 8 an end view of the toilet paper dispenser of FIG. 2, taken along line 8—8.

Referring now to the top cover 16, it may be coupled to the mounting plate 18 in a variety of different manners. As shown in FIGS. 2 and 10, the top cover 16 may be coupled to the mounting plate 18 by inserting a screw 30 through top cover 16 and into a mating opening in mounting plate 18. Alternatively, as shown in FIGS. 8 and 9, the top cover 16 may be constructed to snap-fit into a corresponding receptacle 32 in mounting plate 18.

The top cover 16 acts to conceal a top portion of the roll 20, as shown in FIGS. 1 and 2. In this manner, a person looking down on the dispenser 10 will see the top cover 10 rather than the roll 20, and thus the aesthetic appeal of the dispenser 10 will be enhanced. To this end, it will be desired to provide a top cover 16 with a pleasing color (such as a pastel) and/or design. (Exemplary colors can include mauve, powder blue, black, white, pink, teal, sea green, red, grey, brown, beige, or green.) (Exemplary designs could include dolphins, waterfalls, Mount Rushmore, or landscapes.) So as to adequately cover the top portion of the roll 20, the top cover 16 should extend approximately four and one-half inches outward from the mounting plate 18, and should have a circumference of approximately two and one-half inches. It also preferably has a thickness of about one-eighth of one inch. The top cover 16 also assists a user in the tearing off of a sheet of toilet paper from roll 20, by allowing such tearing action to take place against the top cover 16.

In order to affix the mounting plate 18 to a wall 34, it is preferable to provide a plurality of openings 36 in the mounting plate 18. It will be desired to space the openings 36 so as to provide for a stable mounting of the mounting plate 18. Mounting hardware, such as screws 38, may be inserted through the openings 36. Where the wall 34 is drywall, it may be appropriate to anchor one or more of the screws 38. In this regard, it is preferred to use a butterfly type of anchor 40. This permits the attachment of the mounting plate 18 to a drywall type of wall in a relatively strong manner as compared to the simply use of a metal screw, and can help avoid damage to the wall and the need to re-attach the dispenser and repair the wall.

Figure 6:
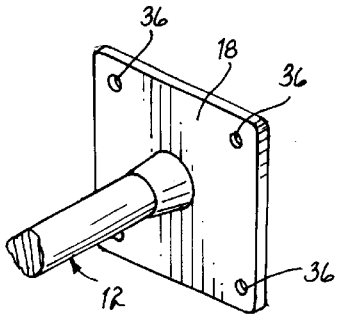
FIG. 6 is a perspective view of another embodiment of a toilet paper dispenser consistent with the present invention.
Figure 3:
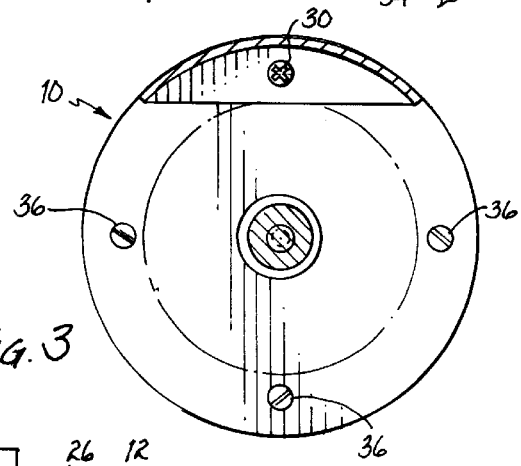
FIG. 3 is an end, cross-sectional view of the toilet paper dispenser of FIG. 2, taken along line 3—3.
Figure 7:
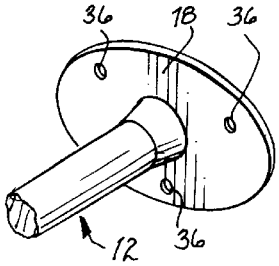
FIG. 7 is a perspective view of another embodiment of a toilet paper dispenser consistent with the present invention.

It should be recognized that the mounting plate 18 can have a variety of different shapes, as desired. For example, the mounting plate 18 could be circular (see, e.g., FIGS. 1, 3, 8 and 10), square (FIG. 6), or oval (FIG. 7). Other shapes may also be utilized for the mounting plate 18, as desired. Where the mounting plate 18 is circular, it is preferred that it have a diameter of about five inches.

Figure 11:
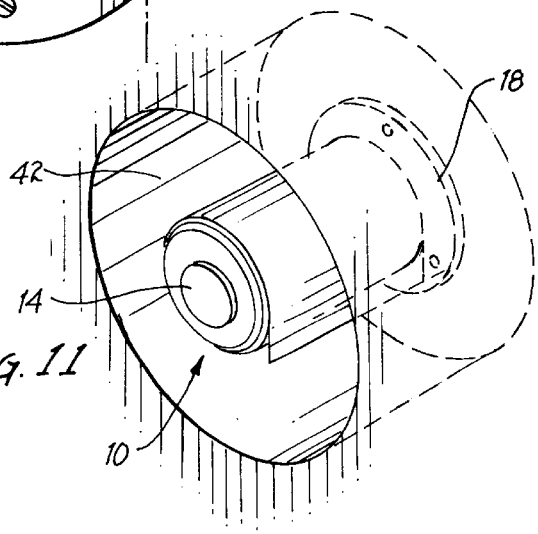
FIG. 11 is a perspective view of another embodiment of a toilet paper dispenser consistent with the present invention.

Referring now to FIG. 11, another embodiment of the dispenser 10 of the present invention is shown. In this embodiment, an opening 42 is created in a wall (not shown). The opening 42 should have sufficient depth so that, upon installation of the mounting plate 18 therein, the end cap 14 is approximately flush with the surface of the wall.) This embodiment permits a discrete mounting of the dispenser 10, and also prevents it from protruding from the wall surface. In this embodiment, a top cover is not required.

While the invention has been particularly shown and described with reference to preferred embodiments thereof, it will be understood by those skilled in the art that the foregoing and other changes in form and details may be made therein without departing from the spirit and scope of the invention.

I claim:

1. A toilet paper dispenser comprising, in combination:

a vertical mounting plate adapted to be attached to a vertical wall surface portion;

a solid spool having a first end connected to a front surface portion of said vertical mounting plate and a second end adapted to receive thereon a roll of toilet paper, said solid spool projects at a substantially right angle from said vertical mounting plate, said second end of said solid spool having a recess portion;

an end cap having a protrusion portion adapted to be inserted into and removed from said recess portion of said second end of said solid spool to permit said end cap to be rapidly attached to said second end of said solid spool when said protrusion portion of said end cap is inserted into said recess portion at said second end of said solid spool and to also permit said end cap to be rapidly detached from said solid spool when said protrusion portion of said end cap is removed from said recess portion of said second end of said solid spool, said end cap having a diameter larger than a diameter of said solid spool at said second end of said solid spool to hold said roll of toilet paper on said solid spool; and an immovable top cover fixedly connected to a top portion of said vertical mounting plate at one end of said top cover and having another end of said top cover extending outwardly from said mounting plate over a substantial portion of said solid spool, said immovable top cover extending over a top portion of said roll of toilet paper when positioned on said solid spool and spaced from said solid spool at a distance beyond a distance provided by a complete roll of toilet paper when positioned on said solid spool.

2. The toilet paper dispenser of claim 1 wherein said protrusion portion of said end cap snaps into and out of said second end of said solid spool.

3. The toilet paper dispenser of claim 1 wherein said solid spool comprises a tapered section having a narrow portion and a larger portion, said larger portion of said tapered section providing said first end of said solid spool and connected to said vertical mounting plate, said solid spool also comprises a cylindrical section, one end of said cylindrical section in contact with said narrow portion of said tapered section and another end of said cylindrical section providing said second end of said solid spool, said tapered section of said solid spool increasing the strength of said solid spool.

4. A toilet paper dispenser comprising, in combination:

a vertical mounting plate adapted to be attached to an interior wall surface portion located in a pre-formed cavity inside a wall;

a solid spool having a first end connected to a front surface portion of said vertical mounting plate and a second end adapted to receive thereon a roll of toilet paper, said solid spool projects at a right angle from said vertical mounting plate, said second end of said solid spool having a recess portion; and an end cap having a protrusion portion adapted to be inserted into and removed from said recess portion of said second end of said solid spool to permit said end cap to be rapidly attached to said second end of said solid spool when said protrusion portion of said end cap is inserted into said recess portion at said second end of said solid spool and to also permit said end cap to be rapidly detached from said solid spool when said protrusion portion of said end cap is removed from said recess portion at said second end of said solid spool, said end cap having a diameter larger than a diameter of said solid spool at said second end of said spool to hold said roll of toilet paper on said solid spool, said solid spool and said end cap connected thereto located within said cavity and having a length substantially equal to a depth of said cavity.

* * * * *